US005830240A

United States Patent [19]

Lin et al.

[11] Patent Number: 5,830,240

[45] Date of Patent: Nov. 3, 1998

[54] FIBERS AND TEXTILE MATERIALS HAVING ENHANCED DYEABILITY AND FINISH COMPOSITIONS USED THEREON

[75] Inventors: Ting D. Lin, Conyers, Ga.; Gregory D. George, Rocky Face, Ga.; Mark A. Brophy, Chattanooga, Tenn.; Debra N. Hild, Cantonment; Doris A. Culberson, Pensacola, both of Fla.; Theresa M. Ortega, San Diego, Calif.; P. Robert Peoples; Bascum Harry Duke, both of Pensacola, Fla.

[73] Assignee: Solutia Inc., St. Louis, Mo.

[21] Appl. No.: 736,032

[22] Filed: Oct. 23, 1996

[51] Int. Cl.[6] ..... D06P 1/613; D06P 1/645

[52] U.S. Cl. ..... 8/478; 8/445; 8/606; 8/576; 8/552; 8/555; 8/558; 8/580; 8/494

[58] Field of Search ..... 8/478, 446, 448, 8/606, 576, 552, 555, 558, 580, 494

[56] References Cited

U.S. PATENT DOCUMENTS

| | | | |
|---|---|---|---|
| Re. 30,143 | 11/1979 | Vertegaal | 101/120 |
| 2,336,775 | 9/1943 | Bock | 8/606 |
| 3,518,184 | 6/1970 | Potter | 252/8.75 |
| 3,549,530 | 12/1970 | Proffitt | 252/8.8 |
| 3,560,382 | 2/1971 | Finch | 252/8.9 |
| 3,630,259 | 12/1971 | Brignac | 152/359 |
| 3,649,535 | 3/1972 | Clark et al. | 252/8.75 |
| 3,652,419 | 3/1972 | Karg | 252/8.8 |
| 3,653,955 | 4/1972 | Habib | 117/139.5 A |
| 3,859,122 | 1/1975 | Burks et al. | 117/138.8 |
| 3,869,250 | 3/1975 | Wegmuller et al. | 8/606 |
| 4,030,880 | 6/1977 | Holfeid et al. | 8/15 |
| 4,179,544 | 12/1979 | Newkirk et al. | 428/395 |
| 4,245,992 | 1/1981 | Yamashita et al. | 8/461 |
| 4,263,009 | 4/1981 | Brendle et al. | 8/495 |
| 4,391,605 | 7/1983 | Bakker | 8/495 |
| 4,416,787 | 11/1983 | Marshall et al. | 252/8.8 |
| 4,441,884 | 4/1984 | Baumann et al. | 8/542 |
| 4,446,034 | 5/1984 | Kolbe et al. | 252/8.8 |
| 4,455,147 | 6/1984 | Lewis et al. | 8/471 |
| 4,475,920 | 10/1984 | Baumann | 8/542 |
| 4,519,803 | 5/1985 | Clare et al. | 8/445 |
| 4,583,987 | 4/1986 | Kurz | 8/495 |
| 4,693,728 | 9/1987 | Clare et al. | 8/561 |
| 4,715,863 | 12/1987 | Navratil et al. | 8/440 |
| 4,728,337 | 3/1988 | Abel et al. | 8/606 |
| 4,734,277 | 3/1988 | Login | 424/70 |
| 4,740,214 | 4/1988 | McBride et al. | 8/561 |
| 4,764,306 | 8/1988 | Login | 260/404 |
| 4,812,263 | 3/1989 | Login | 260/404 |
| 4,818,245 | 4/1989 | Jachowicz et al. | 252/8.8 |
| 4,826,504 | 5/1989 | Clare et al. | 8/561 |
| 4,859,208 | 8/1989 | Clare et al. | 8/557 |
| 4,872,325 | 10/1989 | Moser et al. | 68/200 |
| 4,906,413 | 3/1990 | Töpfl et al. | 260/404.5 |
| 4,966,725 | 10/1990 | Singer et al. | 252/8.8 |
| 5,006,125 | 4/1991 | Patton et al. | 8/188 |
| 5,082,697 | 1/1992 | Patton et al. | 427/340 |
| 5,153,317 | 10/1992 | Ortega et al. | 8/543 |
| 5,252,103 | 10/1993 | Kamata et al. | 8/554 |
| 5,320,646 | 6/1994 | Patton et al. | 8/188 |
| 5,348,557 | 9/1994 | von der Eltz et al. | 8/188 |
| 5,403,358 | 4/1995 | Aston et al. | 8/445 |
| 5,435,807 | 7/1995 | Kuhn | 8/490 |
| 5,525,243 | 6/1996 | Ross | 252/8.6 |
| 5,645,751 | 7/1997 | Haley | 252/8.91 |

FOREIGN PATENT DOCUMENTS

| | | | |
|---|---|---|---|
| 1587930 | 4/1981 | United Kingdom | D06P 5/00 |

OTHER PUBLICATIONS

Stanley E. Ross, "Fiber Finish Challenges for the 90's," Henkel Corporation, pp. 1–6 (May 1993).

"Surfactants A Comprehensive Guide," Research and Development Staffs of Kao Corporation, pp. 111–138 (Apr. 1983).

W. Postman, "Spin Finishes Explained," Textile Research Journal, pp. 444–435 (Jul. 1980).

Dr. N.B. Nevrekar et al., "Spin Finishes for Synthetic Fibers—Part IV," Man–Made Textiles in India, pp. 331–336 (Sep. 1991).

Davis E. Lee, Ph.D., "Surfactants in Spin Finishes," IFJ, pp. 94–100 (Aug. 1991).

H.D. Weigmann, "Finish Distribution and its Effect on Fiber, Yarn, and Fabric Properties," TRI/Princeton, Quarterly Status Report No. 5, pp. 1–5 (Jul. 21, 1993).

Annis et al, *Xanthan: An Effective Antimigrant For Dissolved Substances*, American Dyestuff Reporter, 85 (2): 39–44 and 48 (Feb.) (1996).

*Dyeing Primer, A Series of Short Papers on the Fundamentals of Dyeing*, Textile Chemist And Colorist, 2–38 No month available (1987).

*Primary Examiner*—Margaret Einsmann
*Attorney, Agent, or Firm*—Arnold, White & Durkee

[57] ABSTRACT

A fiber finish composition is described which enhances the dyeability of the fiber or textile materials made from the fiber. The finish composition includes an alkyl substituted quaternary ammonium cation and a barrier agent. An aqueous dispersion of the finish composition is the preferred method of applying the finish composition to fibers. Also included is an improved method of dyeing fibers and textile materials using the fiber finish composition.

8 Claims, No Drawings

FIBERS AND TEXTILE MATERIALS HAVING ENHANCED DYEABILITY AND FINISH COMPOSITIONS USED THEREON

BACKGROUND OF THE INVENTION

1. Field of the Invention

The present invention is generally related to pattern or print dying of textile materials in which the fibers constituting the textile material have been treated with a finish composition that improves pattern definition and color saturation.

2. Background

Textile materials, including fabric, cloth, drapery material, velour, velvet, velveteen, corduroy, rugs, carpet and the like are commonly patterned or printed with natural and synthetic dyes by well known processes, such as transfer printing, jet dye injection, screen printing, Kuster printing, and the like. Indeed there are many such processes that will be apparent to one of ordinary skill in the relevant art. However, despite the success of many of these techniques, undesirable characteristics such as poor pattern definition, low dye yield, and "frostiness", a visual effect in which the surface of the material appears covered in a thin frosting of ice, are the focus of continuing research efforts within the industry. Many of these undesirable characteristics are believed to be due to uncontrolled dye diffusion or moisture transport during the initial transfer of the dyestuff solution to the textile material and during the first moments of the steam treating process that fixes the dye to the fibers that make up the textile material.

Previous attempts at alleviating the above noted undesirable characteristics have met with only limited success and acceptance. One approach has been the incorporation into the dyestuff solution of thickeners to reduce or prevent the diffusion of the dyestuff into the fiber. Examples of such anti-diffusion agents include natural and synthetic gums, such as alginates, xanthan gum, guar, starch, carboxymethyl cellulose, natural and synthetic resins and the like. The synthetic gum systems are not robust, that is, they are sensitive to salts and metal ions which reduce or degrade the viscosity of the dyestuff solution. This in turn reduces the amount of dyestuff that is actually fixed to the fibers of the textile material leading to the wasteful use of these expensive materials.

Another approach, as disclosed in U.S. Pat. No. 4,740,214, has been the use of an ionic interaction between an ionic polymer in the dyestuff solution and a counter ionic polymer coated onto the textile material. It has been speculated that the ionic interaction of the two polymers, once brought into contact with each other, forms a "skin" about the droplets of the dyestuff solution which adhere to the surface of the fiber. When the printed textile material is steam treated in the fixing process, the skin breaks and the dyestuff is fixed before diffusion can occur. This later approach may require capital investment in additional process machinery for pretreating the textile material before print dyeing and adds additional steps and thus cost to the print dying process.

SUMMARY OF THE INVENTION

The present invention is generally directed to a dyeable fiber made of natural or synthetic materials onto which a composition including an alkyl substituted quaternary ammonium cation and a barrier agent has been applied. More particularly, the composition is a finish composition including at least one lubricating agent, an alkyl substituted quaternary ammonium cation and a barrier agent, the alkyl substituted ammonium cation and the barrier agent being present in amounts to enhance the dyeability of the fiber.

Another aspect of the present invention is directed to a process for enhancing the dyeability of a fiber including applying to the fiber a composition including an alkyl substituted quaternary ammonium cation and a barrier agent. More specifically, the process is useful in an improved process for pattern dyeing a textile material made of fibers. The improved process includes treating the fibers with a finish composition, processing the fibers so as to form the textile material, applying to the textile material a pattern of a dyestuff solution containing at least one dyestuff and heating the textile material to a temperature sufficient to fix the dyestuff to the textile, the improvement being formulating the finish composition so as to include an alkyl substituted quaternary ammonium cation and a barrier agent in an amount to enhance the dyeability of the textile material.

Yet a third aspect of the present invention is a finish composition including lubricating agent and alkyl substituted quaternary ammonium cation and a barrier agent. The finish composition is formulated so that upon application to fibers, enhanced dyeability is realized.

DESCRIPTION OF ILLUSTRATIVE EMBODIMENTS

The following terms and phrases are used herein and are intended to have the following meaning "dyeability" is the ability of a fiber constituting a textile material to be fixed with a dyestuff;

"dyestuff" is any natural or synthetic compound or mixture of compounds used to color or dye the fibers of a textile material to achieve a desired visual effect;

"textile material" is any spun, knitted, woven, pressed, non-woven, or otherwise formed material made from natural or synthetic fibers or mixtures or blend thereof, including fabric, cloth, drapery material, velour, velvet, velveteen, corduroy, rugs, carpet and the like onto which printing or patterning is desired;

"fiber" is any natural or synthetic fiber, in continuous filament or staple form which may be spun, knitted, woven, pressed of otherwise formed into a textile material, including cotton, wool, hemp, flax, animal hair, nylon, polyester, polyamide, polyolefin and so forth and combinations or blends of these materials.

As noted above, the present invention is generally directed to a fiber useful in the making of textile materials having enhanced dyeability. More specifically, the present invention is directed to a fiber used to make textile materials that are especially useful in pattern or print dyeing applications in which sharp pattern definition and a high level of color saturation is desired. One of ordinary skill in the art will appreciate that a wide variety of techniques may be used in the pattern dyeing of textile materials and that such techniques will depend upon the textile material to be printed, the nature of the pattern, and so forth. However, it will be further appreciated that given the present disclosure that the fibers and textile materials derived therefrom can be used in pattern or printing techniques such as jet injection dyeing, screen printing, Kuster printing and dyeing, warp printing, space dyeing, continuous yarn dyeing and other low wet pickup dyeing techniques well known in the art.

The fiber of the present invention includes a fiber base made of natural or synthetic material onto which an improved finish composition has been applied. The fiber base may be of natural or synthetic material. An important role of any finish composition is to lubricate the fiber and reduce static build-up during the yarn construction process and the weaving, knitting, tufting or other processing used to make the textile material. In addition to this role, and as will be shown below, the improved finish compositions of the present invention enhance the dyeability of the fibers which results in a final textile material having greater pattern definition and color saturation and reduced frostiness.

Conventional finish compositions are often formulated to include lubricating agents, wetting agents, antistatic agents, leveling agents and other components which are normally liquids at room temperature. These agents and compounds should be apparent and well known in the art for such uses in fiber finish compositions. Fiber finish compositions and related formulating technology are generally described in a number of U.S. Patents including Numbers: 3,518,184; 3,549,530; 3,859,122 and 4,179,544 the contents of which are hereby incorporated herein by reference. Finish compositions are typically sprayed, kiss-rolled, metered, padded or otherwise coated onto the fiber base before the fiber is gathered onto spools, spindles, totes, bales or other conventional transport means.

The improved finish compositions of the present invention are formulated so as to include, in addition to the conventional lubricating agents, and other agents conventionally found in finish compositions, an alkyl substituted quaternary ammonium cation and a barrier agent. The alkyl substituted quaternary ammonium cation and the barrier agent are selected so as to be soluble in the improved finish composition. This avoids the friction increasing effect or salting out effect encountered when inorganic salts or other insoluble compounds are added to the finish composition.

Alkyl substituted quaternary ammonium cations suitable for use in the finish compositions of the present invention include those compounds in which the cation is preferably polyionic. Polyionic compounds are those compounds which possess a charge greater than 1+. Compounds containing two or more quaternary ammonium functional groups are preferred and those with only two are more preferred. In addition to being polyionic, suitable alkyl substituted quaternary ammonium cations should be solids or semi-solids at ambient temperatures. Thus compounds having a melting point from about 10° C. to about 110° C. and more preferably from about 40° C. to about 70° C. should be used. Compounds having the general formula:

$$[(H_{2x+1}C_x)(H_{2y+1}C_y)(H_{2z+1}C_z)N(CH_2)_nCH(OR)(CH_2)_{n'}N(C_{x'}H_{2x'+1})(H_{2y'+1}C_{y'})(H_{2z'+1}C_{z'})]^{++}$$

wherein x and x' have a value from 1 to 4; y and y' have a value from 1 to 4; z and z' have a value from 1 to 20; and n and n' have a value from 1 to 20 are suitable for the improved finish compositions disclosed herein. Preferable values for x, x', y, and y' are 1 thus generating two methyl groups on each quaternary ammonium functional group. Values for n should preferably be no greater than about 4 with a value of one being more preferred. The R group in the central portion of the molecule is selected from the group including hydrogen and $C_1$ to $C_6$ straight, branched and cyclic alkyl groups, and is preferably hydrogen. Preferably the value of z and z' is greater than about 10 and more preferably greater than about 15. The alkyl substituted quaternary ammonium cation is provided as part of a salt in which the anion is chosen so as to not interfere with the dyeing process. Preferably the anion is selected from the group including halide, sulfate, nitrate, acetate and mixtures thereof.

Suitable barrier agents are those compounds that tend to form films, such as waxes, oils, silicone oils, natural and synthetic polymers and the like that are at least partially soluble or dispersible in water. Preferably the barrier agent should be a solid or semi-solid at room temperature and thus have a melting point greater than about 10° C. More preferably, the barrier agent should be selected so as to have a melting point of at least about 10° C. preferably about 20° C. and no greater than about 100° C. and most preferably around or about 50° C.

In addition to the above noted characteristics, the barrier agent should be stable or at least chemically resistant to the pH conditions typically found in dyestuff solutions. Preferably the pH stability or resistance characteristic of the barrier agent should be able to withstand exposure to a dyestuff solution having a pH value from about 3 to about 6. Compounds that have been found to be suitable as barrier agents may be selected from the group of polymeric compounds including ethoxylated castor oils, polyglycolethers, polyethylene oxides, polyalkylene oxides, ethoxylated polyesters, polyacrylic acids, polyacrylamides, polyvinyl alcohols, and mixtures thereof. In one preferred embodiment, the barrier agent is an ethoxylated caster oil having a high molecular weight and more than about 36 ethylene oxide monomer repeating units.

Formulation of the improved finish compositions of the present invention takes place using conventional formulating and mixing technologies that should be apparent to one of ordinary skill in the art. As noted above, the preferred base material for the improved finishing compositions is a conventional finish composition to which the alkyl substituted quaternary ammonium cation and the barrier agent are added. The amounts used should be in sufficient quantities so as to enhance the dyeability of the fiber, but not so great as to eliminate the lubricating, antistatic and other properties of the base finish composition. In one preferred embodiment, the amount by weight of alkyl substituted quaternary ammonium cation is from about 10% to about 20% and the amount by weight of the barrier agent is from about 10% to about 60%. In a more preferred embodiment, the amount by weight of alkyl substituted quaternary ammonium cation is from about 15% to about 20% and the amount by weight of the barrier agent is from about 25% to about 35%.

Preferably the finish composition should have a pH value comparable to the dyestuff solution that is to be used in dyeing the textile material. In embodiments in which acid dyestuffs are used, the pH value of the finish composition should be equal to or less than about 7 and more preferably from about 3 to about 6. Strong anionic chelating agents that are carbonate based, such as ethylenediaminetetraacetate (EDTA), or phosphonates should be avoided. The above improved finish composition may be conventionally applied, preferably by metering.

In another embodiment of the improved finish composition, there is added an alkaline earth salt in sufficient amounts so as to further improve color saturation. Preferably the alkaline earth cation is $Ca^{+2}$. The anion of the salt is selected so as not to interfere in the dyeing process nor adversely affect the lubrication properties of the finish composition. Preferably the anion is selected from the group including, halide, sulfate, nitrate, acetate, lactate, propionate, and mixtures thereof. The amount of alkaline earth metal cation should be sufficient so as to achieve a final concentration on the fiber from about 0 to about 2000 parts of cation per million parts of fiber. In one preferred embodiment the amount of alkaline earth metal cation is sufficient so as to achieve a final concentration on the fiber from about 800 to about 1000 parts of cation per million parts of fiber.

In addition to the above aspects of the present invention, one of ordinary skill in the textile material printing or pattern dyeing art should realize and appreciate that the present invention constitutes an improvement over current state of the art processes. The improved process achieves high levels of pattern definition and color saturation without the need for additional machinery or adding process steps to conventional manufacturing systems. The broad application to a wide variety of printing and patterning techniques, as noted above and to an equally broad range of textile materials is possible and within the scope of the present invention. Examples of the application of a specific technique to specific textile material should be well known to one skilled in the art as evidenced by the following references which are hereby specifically incorporated herein by reference: U.S. Pat. No. : 4,872,325; 4,740,214, Re-30,143.

Generally, the improved process of the present invention includes: treating the fiber base with the improved finish composition as described herein; processing the treated fiber, for example spinning, weaving, knitting, pressing, and so forth, so as to form a treated textile material; applying to the treated textile material a dyestuff solution containing at least one dyestuff; and heating the treated textile material to a sufficient temperature so as to fix the dyestuff to the textile material. The improved finish composition is preferably applied to the fiber in the form of an aqueous emulsion in which the amount of finish composition is from about 5% to about 30% by weight and preferably from about 10% to about 20% by weight. Sufficient amounts of the water/finish composition emulsion are conventionally applied to the fiber base so that the final dry fiber will have a coating of finish composition from about 0.6% to about 2.5% by weight and preferably from about 1.0% to 1.5% by weight. One skilled in the art will appreciate that the finish composition of the present invention need not be applied as an aqueous dispersion, but that it may be applied using suitable organic solvents or directly to the fiber. Therefore such application techniques are considered to be within the scope of the present invention. It should also be kept in mind that the amount should be sufficient so as to lubricate the fiber as well as increase the dyeability of the textile material which in turn results in increased pattern definition, increased color saturation and reduced frostiness in the final textile material.

One skilled in the art should appreciate that the application of the compositions of the present invention may occur after the fiber has been processed into a textile material. In this variation, a conventional finish is used up to and including the textile material formation process after which a "dyeing" finish composition including an alkyl substituted quaternary ammonium cation and a barrier agent is applied before dyeing takes place. Suitable application methods will be apparent to those of ordinary skill in the art and will include spraying, dipping, coating, rolling and other application means. The amount of alkyl substituted ammonium cation and barrier agent used in the "dyeing" finish composition of this embodiment will be in amounts to enhance the dyeability of the textile material. Therefore, one of ordinary skill in the art should know and appreciate that this alternative embodiment is within the scope of the present invention.

The following examples are included to demonstrate preferred embodiments of the invention. It should be appreciated by those of skill in the art that the techniques disclosed in the examples which follow represent techniques discovered by the inventors to function well in the practice of the invention, and thus can be considered to constitute preferred modes for its practice. However, those of skill in the art should, in light of the present disclosure, appreciate that many changes can be made in the specific embodiments which are disclosed and still obtain a like or similar result without departing from the spirit and scope of the invention.

Example 1. Formulation and Application of the Aqueous Finish Composition Emulsion: Sample embodiments of the improved finish composition of the present invention were formulated so as to correspond to the compositions noted in Table 1 below.

TABLE 1

Components and Formulations for Several Embodiments of the Improved Finish Composition

| | Formulation | | | | | | | | | | |
|---|---|---|---|---|---|---|---|---|---|---|---|
| Component | A | B | C | D | E | F | G | H | I | J | K |
| Ethoxylated (28) castor oil | 17.1 | 27.4 | 23.9 | 19.8 | 24.6 | 21.1 | 22.1 | 18.6 | 14.8 | 50.0 | 17.1 |
| Hydrogenated coconut oil | 5.7 | 9.1 | 8.0 | 6.7 | 8.2 | 7.0 | 7.4 | 6.3 | 4.9 | 10.0 | 5.7 |
| Polyalkyleneglycol | 11.4 | 18.2 | 15.9 | 13.3 | 16.3 | 14.0 | 14.8 | 12.5 | 9.8 | 20.0 | 11.4 |
| Polyalkoxylated quaternary amine | 0.0 | 0.0 | 0.0 | 0.0 | 0.0 | 0.0 | 0.0 | 0.0 | 0.0 | 0.0 | 17.1 |
| Polyoxyalkylene decyl ether | 2.9 | 4.6 | 4.0 | 3.4 | 4.1 | 3.6 | 3.8 | 3.2 | 2.5 | 5.0 | 2.9 |
| Ethoxylated (200) castor oil | 45.8 | 29.7 | 37.2 | 45.8 | 29.7 | 37.2 | 29.7 | 37.2 | 45.8 | 0.0 | 45.8 |
| M-quat dimer 18 PG | 17.1 | 11.0 | 11.0 | 11.0 | 17.1 | 17.1 | 22.2 | 22.2 | 22.2 | 15.0 | 0.0 |

To make the aqueous/finish composition emulsion, conventional finish components, including: an emulsifier such as ethoxylated (28) castor oil, at least one lubricant such as hydrogenated coconut oil or polyalkylene glycol, a wetting agent such as polyoxyalkylene decyl ether, were mixed together and added or each was added directly to an appropriately measured amount of water. The alkyl substituted quaternary ammonium compound, 2-hydroxypropylene-bis-1,3-(dimethyl stearyl ammonium chloride) sold under the tradename M-quat dimer 18 PG available from PPG Industries, Inc. and the barrier agent, ethoxylated (200) castor oil (50% active) were added to this mixture which was vigorously stirred and heated so as to form an aqueous emulsion of the finish composition in water. The emulsion was cooled to room temperature and applied to the fiber base in a conventional manner so that the amount by weight of the finish composition on the dry fiber (%OOY) was as shown below in Table 2. In formulations in which calcium was present, the calcium ion was added to the water/finish composition emulsion in the form of calcium acetate. In formulation K, a conventional low molecular weight, monocation polyalkoxylated quaternary amine, conventionally used as an antistatic agent, replaced the alkyl substituted quaternary ammonium compound used in the present invention.

Dyeability Test: Fiber treated with the improved finish composition was conventionally converted into yarn which in turn was tufted into carpet samples. The carpet samples were printed using a dye injection technique on Chromojet equipment. The print paste used in used in of the printing process contained a proprietary blend of natural polymers and xanthan gum, as described in U.S. Pat. No. 5,153,317, the contents of which are hereby incorporated herein by reference. It is available from Monsanto Performance Materials under the tradename K2C378 and was used in accordance to instructions accompanying the product with 2 g per liter Erionyl Blue dye. The dye was fixed to the carpet using conventional steam treatment methods after which it was dried.

The dyeability of the carpet, and hence the fibers, was measured on a relative scale of color strength in which a control sample had a value of 100. Values of relative color strength (RCS) greater than 100 indicate that the carpet has a darker or more intense color. Relative color strength (RCS) was measured on a ColorQuest, spectrocolorimeter available from HunterLab, Hunter Associates Laboratory, Inc. as the reflectance of light having a wavelength of about 600 nm. The control sample was a carpet sample made of commercially available fiber product, Nylon BCF-1360-KET available from Monsanto, processed in the same manner as the test samples, but using a conventional finish composition. The results are given below in Table 2.

TABLE 2

Fiber Dyeability Test Results

| Sample ID | Formulation | % OOY | $Ca^{+2}$ (ppm) | RCS |
|---|---|---|---|---|
| 1 | Control | 1.2 | 0 | 100 |
| 2 | A | 1.2 | 0 | 173 |
| 3 | A | 1.2 | 1000 | 181 |
| 4 | B | 1.2 | 1000 | 175 |
| 5 | C | 1.2 | 1000 | 154 |
| 6 | D | 1.2 | 1000 | 159 |
| 7 | E | 1.2 | 1000 | 149 |
| 8 | F | 1.2 | 1000 | 123 |
| 9 | G | 1.2 | 1000 | 169 |
| 10 | H | 1.2 | 1000 | 146 |
| 11 | I | 1.2 | 1000 | 185 |
| 12 | J | 1.2 | 1000 | 143 |
| 13 | K | 1.2 | 1000 | 141 |
| 14 | A | 1.0 | 800 | 141 |
| 15 | B | 1.0 | 800 | 132 |
| 16 | C | 1.0 | 800 | 142 |
| 17 | D | 1.0 | 800 | 140 |
| 18 | E | 1.0 | 800 | 158 |
| 19 | F | 1.0 | 800 | 158 |
| 20 | G | 1.0 | 800 | 140 |
| 21 | H | 1.0 | 800 | 148 |
| 23 | J | 1.0 | 800 | 138 |
| 24 | K | 1.0 | 800 | 118 |
| 25 | A | 1.0 | 0 | 165 |
| 26 | Control | 1.2 | 0 | 100 |

It should be apparent to one skilled in the art given the above information, sample 11 using finish formulation I with 1000 ppm $Ca^{2+}$ion present gave the highest RCS value indicating that the carpet has the highest level of color intensity when compared to the control. Of special note are samples 2 and 3, both of which have high levels of color intensity (RCS 173 and 181 respectively), and which show that the absence of Ca2 ion has only a small affect on the RCS value (e.g. the color intensity) of the carpet sample.

Example 2: Formulation and Application of the Aqueous Finish Composition Emulsion: As noted above, several improved finish compositions of the present invention were formulated so as to correspond to the compositions noted in Table 3 below.

TABLE 3

Components and Formulations for Several Embodiments of the Improved Finish Composition

| Composition | Formulation A | Formulation L | Formulation M |
|---|---|---|---|
| Ethoxylated (28) castor oil | 17.1 | 14.8 | 13.4 |
| Hydrogenated coconut oil | 5.7 | 4.9 | 7.7 |
| Polyalkylene glycol | 11.4 | 9.8 | 11.0 |
| Polyalkoxylated quaternary amine | 0.0 | 0.0 | 0.0 |
| Polyoxyalkylene decyl ether | 2.9 | 2.5 | 5.0 |
| Ethoxylated (200) castor oil | 45.8 | 45.8 | 45.8 |
| M-quat dimer 18 PG | 17.1 | 22.2 | 17.1 |

The same techniques of formulation, dying and measurement were used as noted above in Example 1. The "control" in this case was a commercially available Nylon staple fiber product T-1993 available from Monsanto. The relative color strength (RCS) of the printed carpets are given below in Table 4.

TABLE 4

Fiber Dyeability Test Results

| Sample | Formulation | % OOY | $Ca^{+2}$ (ppm) | RCS |
|---|---|---|---|---|
| 1 | Control | 1.1 | 0 | 100 |
| 2 | A | 1.0 | 1000 | 144 |
| 3 | A | 1.0 | 0 | 144 |
| 4 | L | 1.0 | 0 | 160 |
| 5 | A | 1.2 | 0 | 174 |
| 6 | L | 1.2 | 0 | 171 |
| 7 | M | 1.2 | 0 | 143 |

As should be apparent to one skilled in the art, sample 5 using finish formulation A achieved the highest value of RCS. Once again the presence of $Ca^{+2}$ ion in the finish formulation has only a minimal effect on the RCS value. It should also be apparent that increasing the amount of finish on the fiber (%OOY) from 1.0 to 1.2 increases the value of RCS and hence the intensity of the color of the final dyed carpet sample.

Example 3: Formulation and Application of the Aqueous Finish Composition Emulsion: Several improved finish composition of the present invention were formulated so as to correspond to the compositions noted in Table 5 below.

TABLE 5

Components and Formulations for Embodiments of the Improved Finish Composition

| Composition | Formulation A | Formulation N | Formulation O | Formulation P | Formulation Q |
|---|---|---|---|---|---|
| Ethoxylated (28) castor oil | 17.1 | 13.4 | 17.1 | 19.6 | 14.8 |
| Hydrogenated coconut oil | 5.7 | 0 | 0 | 0 | 7.7 |
| Polyalkylene glycol | 11.4 | 11.0 | 10.0 | 10.0 | 11.0 |
| Trimethylpropane triargonate | 0 | 7.7 | 11.6 | 14.0 | 0.0 |
| Polyoxyalkylene decyl ether | 2.9 | 5.0 | 3.9 | 3.5 | 3.8 |
| Ethoxylated (200) castor oil | 45.8 | 45.8 | 45.0 | 40.0 | 45.8 |
| M-quat dimer 18PG | 17.1 | 17.1 | 12.4 | 12.9 | 17.1 |

The same techniques of formulation, dying and measurement were used as noted above in Example 1. Formulations N, 0 and P all contain trimethylpropane triargonate available from Henkel Corporation. The "control" in this case was a commercially available fiber product Nylon BCF-1360-KET made by Monsanto. The relative color strength (RCS) of the printed carpets are given below in Table 6.

TABLE 6

Fiber Dyeability Test Results

| Sample | Formulation | % OOY | $Ca^{+2}$ (ppm) | RCS |
|---|---|---|---|---|
| 1 | Control | 1.2 | 0 | 100 |
| 2 | A | 1.2 | 0 | 143 |
| 3 | N | 1.2 | 0 | 109 |
| 4 | O | 1.2 | 0 | 105 |
| 5 | P | 1.2 | 800 | 100 |
| 6 | Q | 1.2 | 0 | 155 |

Based on the above results, it should be apparent to one skilled in the art that the inclusion of trimethylpropane triargonate in the finish formulation does not substantially increase the RCS value.

Example 4: In order to demonstrate the robustness of the embodiments of the improved finish composition of the present invention, print pastes which utilize natural and synthetic polymers as rheology modifiers were compared. One of ordinary skill in the art should realize and appreciate that a large number of suitable thickeners may be used other than those specifically used in this example and that a representative sample has been presented below. The thickeners employed included: K2C328 and K5C468 both proprietary blends available under those tradenames from Monsanto Performance Materials; Tanaprint ST160 a proprietary formulation available under that tradename from Sybron Chemicals, Inc.; Prisulon CSD-10 a proprietary formulation available under that tradename from Catawba Charlab Inc.; and, Texipol a proprietary formulation available under that tradename from Scott-Badder Co. Ltd. The latter three thickeners are synthetic thickeners based on polyacrylate polymer emulsions. One skilled in the art should understand that necessary adjustments in the concentration of the thickener used in the print pastes were needed to provide similar viscosity at a specific measurement as is a practice well known in the art. The dye used was Irgalan Bordeaux EL200 and the dye was applied using Chromojet equipment and fixed with steam as described above in Example 1. The dyeability of the dry carpet samples was measured as noted above in Example 1. The control sample was a commercially available fiber product Nylon BCF-1360-KET available from Monsanto. The results are given in Table 7 below.

TABLE 7

Fiber Dyeability Test Results

| Sample | Formulation | % OOY | $Ca^{+2}$ (ppm) | RCS |
|---|---|---|---|---|
| K2C378 | Control | 1.2 | 0 | 100 |
| K2C378 | A | 1.2 | 0 | 296 |
| K5C468 | Control | 1.2 | 0 | 100 |
| K5C468 | A | 1.2 | 0 | 255 |
| Tanaprint ST160 | Control | 1.2 | 0 | 100 |
| Tanaprint ST160 | A | 1.2 | 0 | 152 |
| Prisulon CSD10 | Control | 1.2 | 0 | 100 |
| Prisulon CSD10 | A | 1.2 | 0 | 177 |
| Texipol | Control | 1.2 | 0 | 100 |
| Texipol | A | 1.2 | 0 | 168 |

As should be apparent to one of ordinary skill in the art, the use of the improved finish composition of the present invention allows for the use of a variety of thickening agents in the print paste with increased color strength.

While the compositions and methods of this invention have been described in terms of preferred embodiments, it should be apparent to those of skill in the art that variations may be applied to the process described herein without departing from the concept, spirit and scope of the invention. All such similar substitutions and modifications apparent to those skilled in the art are deemed to be within the spirit, scope and concept of the invention as it is set out in the following claims.

What is claimed is:

1. A process for pattern dyeing a textile material made of fibers including:

(a) treating the fibers with a finish composition that comprises:

(i) about 10–20% by weight of an alkyl substituted quaternary ammonium cation having the general formula:

$$[(H_{2x+1}C_x)(H_{2y+1}C_y)(H_{2z+1}C_z)N(CH_2)_nCH(OR)(CH_2)_{n'}N(C_{x'}H_{2x'+1})(H_{2y'+1}C_{y'})(H_{2z'+1}C_{z'})]^{++}$$

wherein x and x' have a value from 1 to 4; y and y' have a value from 1 to 4; z and z' have a value from 1 to 20; n and n' have a value from 1 to 20; and, R is selected from the group consisting of hydrogen and $C_1$ to $C_6$ straight, branched and cyclic alkyl groups; and (ii) about 10–60% by weight of a polymeric barrier agent selected from the group consisting of ethoxylated castor oils, polyalkylene oxides, ethoxylated polyesters, polyacrylic acids, polyacrylamides, polyvinyl alcohols, and mixtures thereof, (b) processing the fiber so as to form a textile material;

(c) applying to the textile material a pattern of a dyestuff solution containing at least one dyestuff, and (d) heating the textile material to a temperature sufficient to fix the dyestuff to the textile material.

2. The process of claim 1 wherein the barrier agent is a water soluble polymeric compound that is stable in dyestuff solutions having a pH value from about 3 to about 6, said polymeric compound having a melting point of at least about 20° C. and no greater than about 100° C. and said polymeric compound allowing the dyestuff solution to dye the fibers of the textile material upon heat treatment.

3. The process of claim 2 wherein the barrier agent is an ethoxylated castor oil having about 36–200 ethylene oxide monomer repeating units.

4. The process of claim 1 wherein the alkyl substituted quaternary ammonium cation is polyionic, soluble in the finish composition, and has a melting point of at least about 10° C.

5. The process of claim 1 wherein the values of x, x', y, y', n and n' are all 1 and R is hydrogen.

6. The process of claim 4 wherein the alkyl substituted quaternary ammonium cation is part of a salt in which the anion is selected from the group consisting of halide, sulfate, nitrate, acetate, and mixtures thereof.

7. The process of claim 2, wherein the barrier agent is a polyglycolether.

8. The process of claim 2, wherein the barrier agent is a polyethylene oxide.

* * * * *